United States Patent [19]

Brown

[11] Patent Number: 4,630,021

[45] Date of Patent: Dec. 16, 1986

[54] LOW COST TIME DELAY RELAY ASSEMBLY

[75] Inventor: Ronald W. Brown, Lexington, Ky.

[73] Assignee: Texas Instruments Incorporated, Dallas, Tex.

[21] Appl. No.: 811,124

[22] Filed: Dec. 19, 1985

[51] Int. Cl.[4] ..... H01H 61/01; H01H 37/04

[52] U.S. Cl. ..... 337/113; 337/380

[58] Field of Search ..... 337/113, 112, 381, 380

[56] References Cited

U.S. PATENT DOCUMENTS 3,323,086 5/1967 Pimentel ..... 335/202

3,858,140 12/1974 Hancock ..... 337/112

*Primary Examiner*—Harold Broome

*Attorney, Agent, or Firm*—John A. Haug; James P. McAndrews; Melvin Sharp

[57] ABSTRACT

A time delay relay (TDR) is formed by capturing a thermostatic switch between identical shells of an outer housing and suspending the switch in a switch cavity to minimize heat loss to the outer housing. The shells are bonded together to form a unitary housing member. Heater terminal members are captured in identical grooves formed in the housing shells with the terminals projecting from either the top or bottom of the TDR. An alternate embodiment includes a manual reset mechanism also captured between the housing shells.

10 Claims, 15 Drawing Figures

LOW COST TIME DELAY RELAY ASSEMBLY

BACKGROUND OF THE INVENTION

This invention relates to thermostatic electrical switches and is particularly concerned with a time delay relay (TDR) utilizing a thermostatic switch assembly for opening and closing an electric circuit.

A relay of this type is the subject matter of U.S. Pat. No. 3,858,140 which comprises a thermally responsive switch adapted to make and break an electrical circuit mounted within a chamber of a time delay housing. A heater energized by a second circuit is positioned in heat transfer relation with the switch for heating a thermostatic element in the switch to thereby control the engagement and disengagement of electrical contacts in the switch. The heater and the switch and mounted within the chamber, terminals for energizing the heater are received in slots in the housing and a cover is placed over the chamber which engages the terminals to retain them in the housing. A retaining element interacts with the housing to hold the cover, switch, heater and terminals in assembled position.

Although relays made in accordance with the teachings of this patent have been very successful there are certain inherent characteristics of the structure which limit its usefulness for certain applications calling, for example, for devices having a faster response time or for devices which are less expensive to produce. For example, the one piece housing shown in the patent is a relatively massive member which tends to act as a heat sink and thereby to slow down the reaction time of the thermostatic switch. Since the housing is somewhat massive, it uses a relatively large amount of electrically insulative material adding to the material cost of the device. Further, the housing employs a separate cover of complex configuration as well as a spring retaining element. It has further been found in practice that after the retaining element is placed over the cover member it is frequently preferred to lock it in place with epoxy resulting in extra time required to assemble the device to allow for curing of the epoxy.

It is therefor an object of the present invention to provide a time delay relay having a very fast response time. Another object of the invention is the provision of a relay which has an inherently lower cost than prior art relays. Yet another object is the provision of a relay whose structure is such as to be particularly well suited to mass assembly line techniques. Other objects and features of this invention will be in part apparent and in part pointed out hereinafter.

Briefly, a time delay relay of this invention comprises a housing formed of two identical shells formed with a plurality of grooves and a recess all open from a single direction. The shells have a back, bottom and top walls of generally the same thickness. Two opposite side walls have a free distal end portion forming an edge surface with a terminal receiving groove formed therein and extending through one of the top and bottom walls and having a notch adjacent the bottom wall. The edge surface of one of the side walls is formed with a joining groove and the edge surface of the other with a joining rib. First and second shelves extend from the back and side walls into the recess. A first elongated generally flat terminal member is received in one of the terminal receiving grooves of one shell and has a finger bent back upon itself received through the notch in the respective side wall and finger having a free distal end portion disposed between the first and second shelves. A second generally flat terminal member is received in the other of the terminal receiving grooves of same shell and has a finger extending through the notch in the respective side wall, the finger having a free distal end portion disposed in the recess. A thermostatic switch has a cup shaped metallic cap member mounted at its lower end with the outer periphery forming an annular berm received between the shelves in the same shell with the free distal end of the finger of the first terminal member in engagement with the berm or outer periphery of the cap member. The free distal end of the finger of the second terminal member is in engagement with a contact layer on one side of an electrical resistor element disposed on the cap member. The terminals and the switch extend out of the first shell and the switch is aligned with an aperture formed in the top wall. The other shell is placed over the first with the first terminal member received in the second terminal receiving groove of the other shell and the second terminal member received in the first terminal receiving groove of the other shell. The two halves are bonded together with the recesses forming a cavity in which the thermostatic switch is suspended.

According to a feature of the invention the terminal receiving grooves have spaced abutments to cooperate with tabs formed on the terminals to properly locate the terminals within the grooves. The terminals can extend outwardly either through the top or bottom wall as desired by extending the groove through the respective top or bottom wall.

Preferably the joining groove is formed with a wider mouth portion and the joining rib has a width greater than the joining groove but less than the mouth portion and a height less than the depth of the joining groove to facilitate ultrasonic soldering of the shells together.

According to a feature of the invention a manual reset function can be provided by forming a generally U-shaped platform with a button receiving bore in its bight and two downwardly projecting legs. Each leg has a groove generally equal to the thickness of the top wall adjacent its free distal end. A reset slide member extending through the top wall of the thermostatic switch has a tab which is received in a slot formed in the bottom of the button. The switch is placed in the recess with the platform placed over the aperture in the top wall of the first shell with the top wall received in a portion of the grooves in the legs. The second shell is then placed on the first with the top wall first with the top wall received in the remainder of the grooves in the legs to lock the platform in place.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
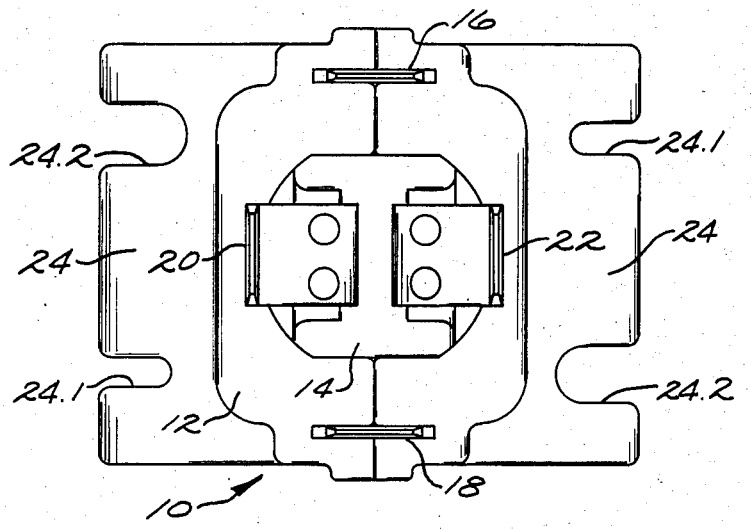
FIG. 1 is a top plan view of a TDR unit made in accordance with the invention.
Figure 2:
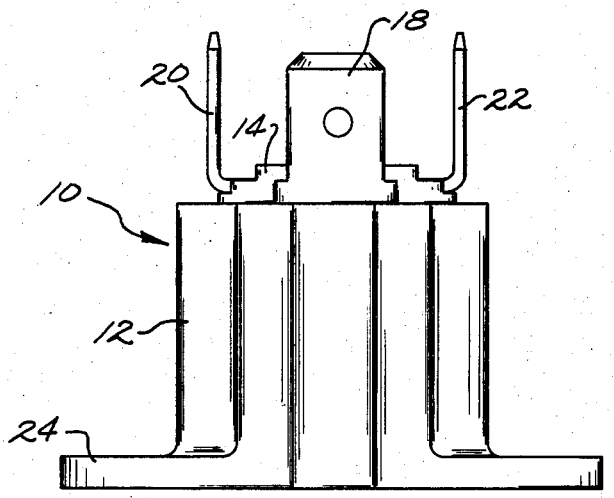
FIG. 2 is a front elevation of the FIG. 1 device.

Referring to the drawings, a time delay unit (TDR) of this invention, generally indicated by reference numeral 10, is comprised of an outer housing 12 in which is disposed a thermostatic switch 14. The TDR employs a heater circuit including first and second terminals 16, 18 respectively which extend from housing 12. Switch 14 is provided with suitable terminals 20, 22 adapted to be connected to a circuit whose energization is to be controlled by the TDR. Housing 12 is formed with a flange 24 having slots 24.1 and 24.2 adapted to receive suitable fasteners for mounting of the TDR to a selected surface. Housing 12 is formed from two identical shells 26 best seen in FIGS. 3–6. Shell 26, formed of a suitable electrically insulative, moldable material such as Ryton, a trademark of Phillips Petroleum Company for glass reinforced polyphenylene sulfide, comprises a top wall 28, back wall 30 and bottom wall 32 all of generally the same thickness and side walls 34, 36 which are somewhat thicker to provide means to mount the heater terminals and join the shells together. Each shell defines a recess 38 which becomes a switch cavity when two shells are joined together as described below.

First and second parallely extending shelves 40 and 42 extend from the back and side walls and project into recess 38. Upper shelf 40 is shown formed by a plurality of portions however if desired it can be made into a single U-shaped configuration similar to lower platform 42. Both shelves are set back from the outer free distal portion of the top, side and bottom walls as indicated at 44 in order to accommodate a contact member to be described below.

Top wall 28 is formed with an aperture 28.1 adapted to accommodate half of the outer perimeter of thermostatic switch 14. Although aperture 28.1 is configured generally as a semicircle it is preferably formed with opposed straight edge portions 28.2 to cooperate with a corresponding configuration of the housing of thermostatic switch 14 including opposed flat surfaces in the outer periphery of the switch to facilitate proper orientation of the switch when assembled in the TDR.

Figure 3:
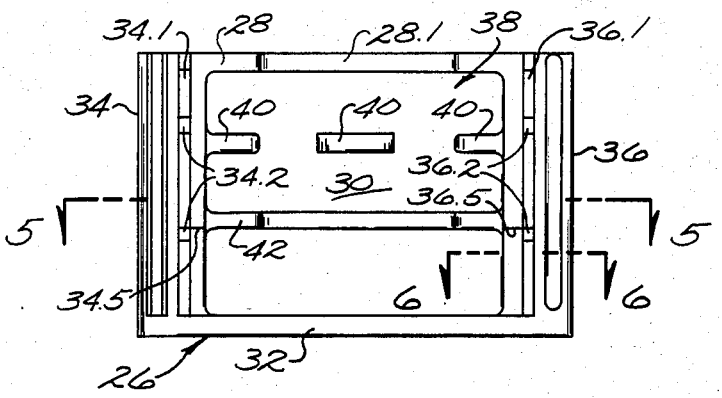
FIG. 3 is a side elevation of one of the housing shells used in the device.
Figure 4:
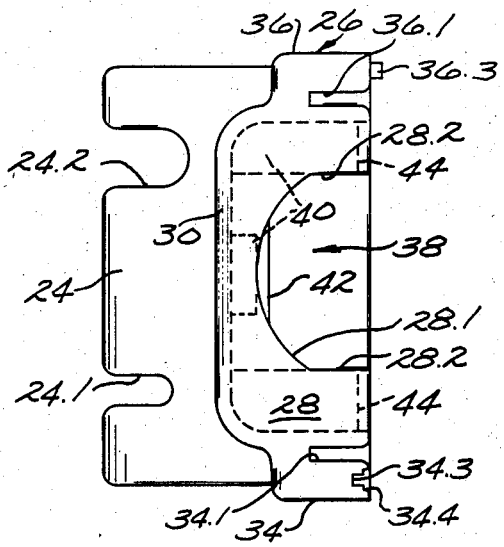
FIG. 4 is a top plan view of the FIG. 3 housing shell.
Figure 5:
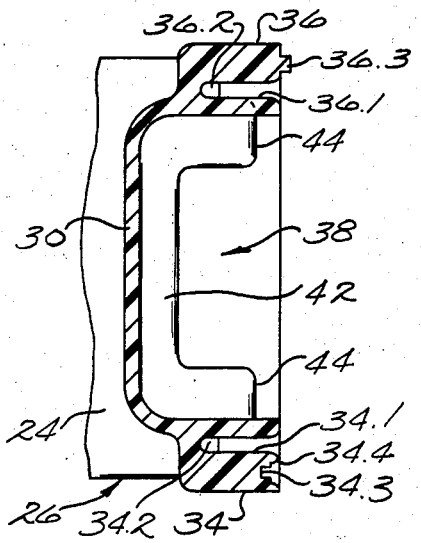
FIG. 5 is a cross sectional view taken on line 5—5 of FIG. 3 with a portion of the mounting flange broken away.

Terminal receiving grooves 34.1 and 36.1 of identical configuration are formed in the edge surface of side walls 34 and 36 respectively and extend along the length of the side walls and through the top wall 28 as shown in FIGS. 3 and 4 if it is desired to locate the heater terminals at the top of the TDR or, as will be described below with reference to FIG. 13 the grooves can extend through bottom wall 32 if it is desired to locate the heater terminals at the bottom of TDR 10. As seen in FIGS. 3 and 5, spaced abutments 34.2, 36.2 are formed in the respective grooves and are adapted to cooperate with tabs formed on terminal members to be described below.

Side 34 is formed with a joining groove 34.3 adjacent terminal groove 34.1 which extends generally parallel to groove 34.1 from the bottom wall up to and preferably through the top wall 28. Joining groove 34.3 has a mouth protion 34.4 wider than the interior closed end portion of the groove. Side wall 36 has a joining rib 36.3 spaced the same distance from the outer surface of side 36 as joining groove 34.3 is spaced from the outer surface of side 34. Joining rib 36.3 extends along side wall 36 in the same manner as the joining groove from the bottom wall up to the top surface of top wall 28. Rib 36.3 projects from the free end of side wall 36 a distance which is less than the depth of joining groove 34.3 and has a width which is less than mouth 34.4 but greater than the remainder of joining groove 34.3 to facilitate ultrasonic welding of two shells together.

Figure 6:
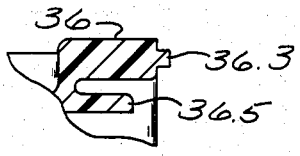
FIG. 6 is a cross sectional view taken on line 6—6 of FIG. 3.

As seen in FIGS. 3 and 6 the side walls are each notched respectively at their lower end, 34.5, 36.5 to provide communication between the terminal groove and recess 38 for reception of a contact finger to be discussed below.

Figure 7:
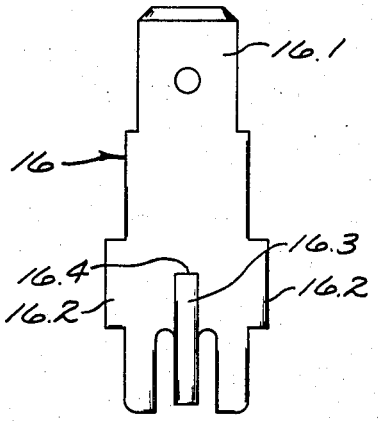
FIGS. 7 and 9 are front elevation views of two heater terminals.
Figure 8:
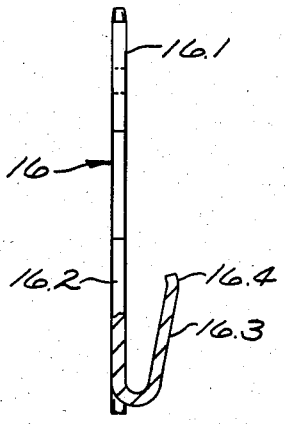
FIGS. 8 and 10 are side elevations, partly in cross section, of the FIGS. 7 and 9 terminals respectively.

A first heater terminal member 16 shown in FIGS. 7 and 8 is formed of a generally flat elongated plate of electrically conductive material being stiff but having good spring characteristics such as phosphor bronze. Terminal member 16 has a conventional bayonet terminal end 16.1 and a pair of tabs 16.2 extend outwardly in opposite directions intermediate the ends of member 16. A contact finger 16.3 is struck from the center of member 16 relative to the longitudinal axis of member 16 and is bent back upon itself terminating at a free distal end portion 16.4. The width of contact finger 16.3 is slightly less than half of the depth of notch 36.5 and the set back 44 of the shelves.

Figure 9:
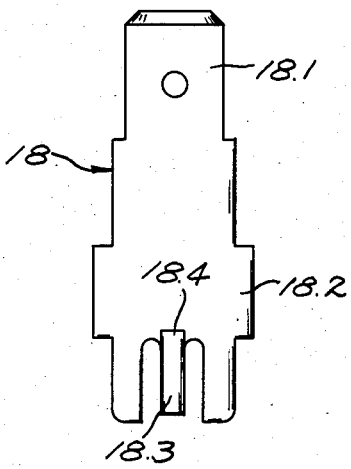
Figure 10:
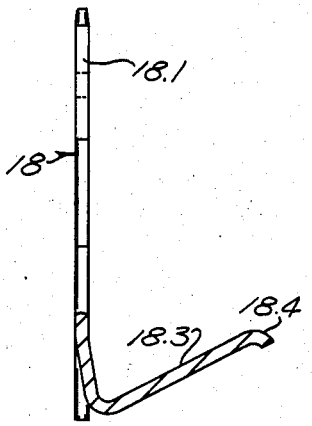

A second heater terminal member 18 shown in FIGS. 9 and 10 is formed of a generally flat elongated plate of electrically conductive material being stiff but having good spring characteristics such as that used for terminal member 16. The configurations of terminal member 18 is identical to that of terminal member 16 except for the contact finger. Member 18 has a bayonet terminal end 18.1 and a pair of tabs 18.2 extending outwardly in opposite directions intermediate the ends of member 18. Member 18 has a contact finger 18.3, also struck from the center of member 18 and of the same width as contact finger 16.3. Contact finger 18.3 is bent out of the plane in which member 18 lies but its distal free end portion 18.4 is spaced further away from the main body portion of member 18 and closer to the lower end of the terminal member than is free distal end 16.4 relative to the main body portion of member 16.

Figure 11:
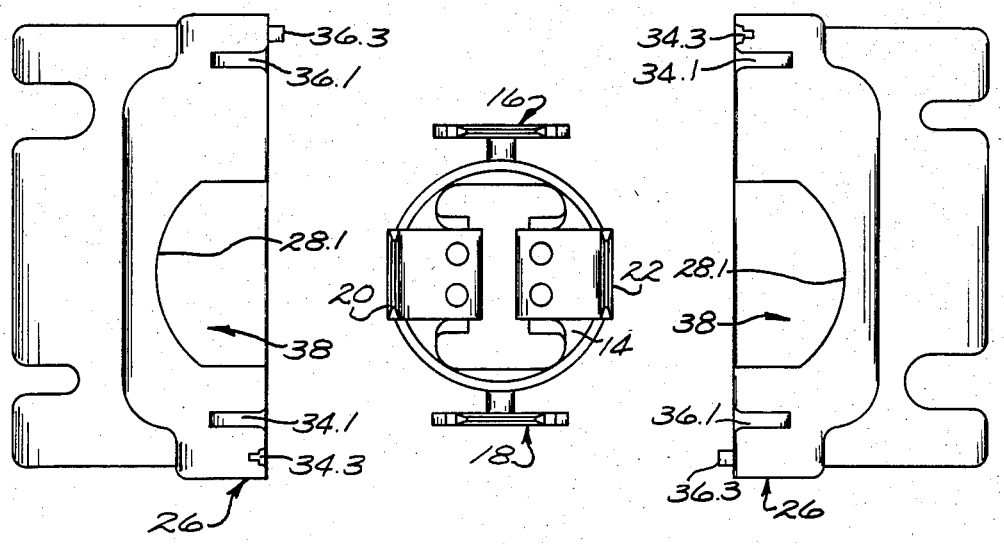
FIG. 11 is a top plan view, blown apart, of a TDR unit including two housing shells, a thermostatic switch and two heater terminals.
Figure 12:
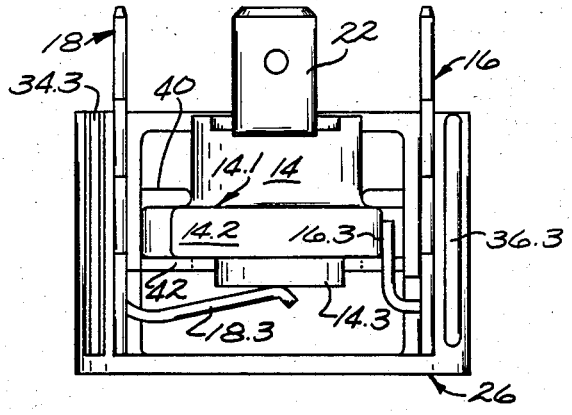
FIG. 12 is a side view of one housing shell with the thermostatic switch and terminals received therein.

The TDR is assembled by placing the thermostatic switch 14 and terminals 16, 18 so that they are captured by two shells 26 as suggested in FIG. 11. That is, terminal 16 is placed in terminal receiving groove 36.1 of one shell 26 with its contact finger extending through notch 36.5 into recess 38 with the distal end portion disposed between shelves 40, 42. Tabs 16.2 are received between abutments 34.2 to properly locate terminal 16 and maintain it lengthwise in position in the groove. Terminal 18 is placed in terminal receiving groove 34.1 of the same shell 26 with its contact finger extending through notch 34.5 into recess 38 with the distal end portion 18.4 somewhat lower than the distal end 16.4 of contact finger 16.3. Thermostatic switch 14 is placed in aperture 28.1 with the top portion of the housing projecting above the top wall of shell 26 to hold and properly orient the switch relative to the shell. Thermostatic switch 14 is provided at its lower end with a generally cylindrical metal cap member 14.1 having an outer peripheral surface or berm 14.2 of a greater diameter than that of the remainder of the housing of the switch. An electrical resistance element 14.3 such as a wafer of PTC (positive temperature coefficient of resistivity) material having contact layers on spaced opposed surfaces is attached to the bottom surface of cap 14.1 in electrical connection therewith in a conventional member. Switch 14 is placed in shell 26 so that berm 14.2 is closely received between platforms 40, 42 and with contact finger 16.3 biased into engagement with the outer periphery of berm 14.2 and contact finger 18.3 biased into engagement with the bottom contact layer of element 14.3.

Another shell 26 is then placed over the first shell with the exposed portion of the terminals 16, 18 below the bayonet end received in the opposite terminal receiving grooves relative to the first shell. That is terminal 16 will be received in terminal receiving groove 34.1 of the second shell and terminal 18 in groove 36.1 with a joining rib 36.3 received in a joining groove 34.3 at each side. These joining ribs and grooves are then subjected to ultrasonic energy in a known manner to weld the two shells together with thermostatic switch 14 suspended in the switch cavity formed by the two recesses 38 being securely captured in the housing yet held in such manner that very little of the heat generated by heater element 14.3 is lost to the outer housing 12 to result in a TDR which has improved (shortened) response time compared to the prior art.

The use of two housing parts formed of identical configuration lowers the cost of the device by requiring only a single mold. Assembly of the TDR is particularly conducive to mass manufacturing techniques in that all the parts are inserted from the same direction.

Figure 13:
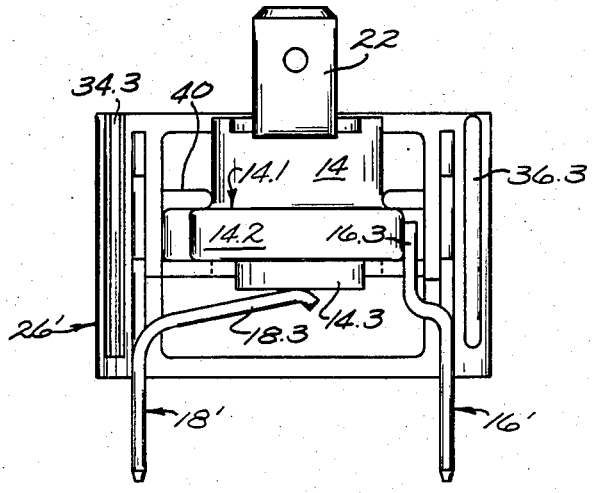
FIG. 13 is a view similar to FIG. 12 of a modification of the TDR unit.

As mentioned supra, if it is desired to locate the heater terminals at the bottom of the TDR the terminal receiving grooves can be extended through the bottom wall of shell 26' as shown in FIG. 13 with terminals 16', 18' appropriately modified to have the bayonet end below the contact finger received in respective terminal receiving grooves 34.1, 36.1.

Figure 14:
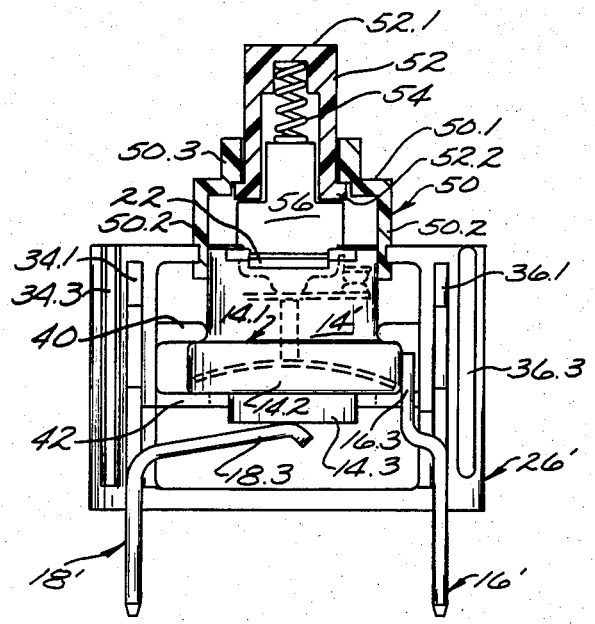
FIG. 14 is a view similar to FIGS. 12 and 13 showing a manually resettable TDR unit made in according with the invention.
Figure 15:
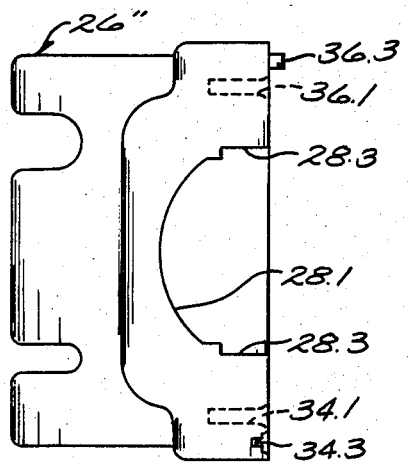
FIG. 15 is top plan view of a housing shell used in the FIG. 14 manually resettable TDR.

FIG. 14 shows another embodiment of the invention in which a manual reset function is added to the TDR. A shell 26'', identical with shell 26' shown in FIG. 13 except for an enlarged aperture portion 28.3 (FIG. 15) cooperates with a generally U-shaped mounting platform 50 having a central bight 50.1 and legs 50.2 extending downwardly therefrom. The edges of enlarged aperture portion 28.3 are adapted to slide into a groove formed adjacent the free distal end of each leg 50.2. In order to provide clearance for platform 50 terminals 20, 22 are formed so that they extend laterally outwardly (see terminal 22 in FIG. 14). A bored hub 50.3 is formed on bight 50.1 with a hollow button 52 slidably received therein. Button 52 has a closed end 52.1 and an opposed open end with a radially extending flange 52.2 to lock the button in platform 50. A coil spring 54 is disposed in the hollow button between the closed end and a reset slide member 56 which extends into the hollow button, through the top wall of thermostatic switch 14'. Slide member 56 is adapted to reset the switch mechanism as shown schematically by the dashed lines indicative of a switch mechanism, motion transfer member and thermostatic disc with a movable contact arm engaged by slide member 56. It will be understood that when it is desired to provide a manually resettable TDR the thermostatic disc used in the thermostatic switch is bistable, that is, it is formed so that when it snaps from one dished configuration to a second opposite configuration (e.g. from concave to convex) upon being subjected to a selected heat input it will maintain the second configuration even though the heat input is removed and the temperature of the disc is lowered. The device is reset by physically pushing the bulged disc through the motion transfer member by means of slide 56.

In assembling the manually resettable TDR a reset assembly including platform 50, button 52 and spring 54 is placed over a thermostatic switch 14' modified to mount a slide 56 and the switch and button assembly are inserted into a shell 26'' with edges 28.3 in the top wall of the shell received in the grooves in legs 50.2 of platform 50. A second shell 26'' is received over the first to capture the reset assembly in the same manner as the terminal members and switch.

It will be understood that the two housing shells can be fixed to one another by means other than ultrasonic bonding if so desired. For example they can be fixed together by using a bonding agent such as an epoxy or a separate clip could be employed. In such cases the joining groove and rib would be appropriately modified.

In view of the above it will be seen that the several objects of the invention are achieved and other advantages results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A time delay relay having improved response time comprising a two piece housing, the two pieces being identical to each other and formed of a moldable electrically insulative material and being adapted to suspend a thermostatic switch in a cavity with minimal heat loss from the switch to the housing, each piece comprising a shell formed with a plurality of grooves and a recess all open from a single direction, the shell having a top wall with an aperture defined in the top wall and being open in the single direction, two opposed side walls forming with back, top and bottom walls a recess, the side walls having a free distal end portion having an edge surface, each edge surface having a terminal receiving groove extending along the edge surface and through one of the top and bottom walls and being open from the said single direction, each side wall having a notch formed adjacent the bottom wall so that the terminal receiving groove is in communication with the recess, first and second shelves extending from the back and side walls into the recess, the edge surface of one of the side walls formed with a joining groove open from the said single direction and the edge surface of the other side wall formed with a joining rib, a first elongated generally flat terminal received in one of the terminal receiving grooves of one shell, the terminal having a finger bent back upon itself and being received through the notch in its respective side wall and having a free distal end portion disposed between the first and second shelves, a second elongated generally flat terminal received in the other of the terminal receiving grooves of the one shell, the second terminal having a finger extending through the notch in its respective side wall and having a free distal end portion disposed in the recess, a thermostatic switch having an upper and a lower end, a cup shaped metallic cap member mounted on the lower end of the switch housing and having a bottom surface and a cylindrical outer peripheral surface projecting radially beyond the switch housing, a resistive heater element having opposed contact surfaces, one contact surface electrically connected to the bottom surface of the cap member, the switch being disposed in the recess of the one shell with the cap member received between and held by the shelves and the upper end of the switch extending through the aperture in the top wall, the distal end portion of the finger of the first terminal in contact with the cap member and the distal end portion of the finger of the second terminal in contact with the other contact surface of the heater element, the first and second terminals and the thermostatic switch all extending out of the recess of the shell, and the other shell received over the first shell with the joining ribs received in the joining grooves, the first terminal received in the other terminal receiving groove of the other shell and the second terminal received in the said one terminal receiving groove of the other shell, the two shells being bonded together to form a unitary housing with the recess of each shell combining to form a switch cavity, the switch and terminals captured between the shells.

2. A time delay relay according to claim 1 in which the joining groove has a given depth and has a mouth portion with a width greater than the remainder of the groove and the joining rib has a given height less than the depth of the joining groove and a width greater than the width of the mouth and less than the width of the remainder of the joining groove, and the two shells are ultrasonically welded together through their joining grooves and ribs.

3. A time delay relay according to claim 1 in which the first and second terminals are each formed with a tab projecting from opposite sides thereof and a pair of abutments are formed in each terminal receiving groove, the abutments of a pair spaced apart and so located in a respective terminal receiving groove as to receive a terminal tab between the abutments of a pair to locate the terminal in a selected position in the terminal receiving groove.

4. A time delay relay according to claim 1 in which the resistive heater has a positive temperature coefficient of resistivity.

5. A time delay relay according to claim 1 further including manual reset means comprising a slide member extending from a point outside the thermostatic switch into its upper end, a platform having first and second legs depending therefrom, the legs each having a free distal end with a groove formed adjacent to the free distal end, the edge of the aperture in the top wall of the shells received in each groove so that the platform is locked to the housing and a button engageable with the slide member mounted in an aperture formed in the platform, the button adapted to transfer motion to the slide member.

6. A time delay relay according to claim 1 in which the top, bottom and back walls are approximately the same thickness.

7. A time delay relay according to claim 1 in which the housing of the thermostatic switch is formed with a pair of flat surfaces in its outer periphery and the aperture in the top wall of the shells have straight edges to cooperate with the flat surfaces to assure a given orientation of the thermostatic switch when placed between a pair of shells.

8. A time delay relay having improved response time comprising a two piece housing, the two pieces being identical to each other and formed of a moldable, electrically insulative material and being adapted to suspend a thermostatic switch in a cavity with minimal heat loss from the switch to the housing, each piece comprising a shell having a top wall with a aperture defined therein, two opposed side walls forming with back, top and bottom walls a recess, the side walls having a free distal end portion having an edge surface, each edge surface having a terminal receiving groove extending along the edge surface and through one of the top and bottom walls each side wall having a notch formed adjacent the bottom wall so that the terminal receiving groove is in communication with the recess, first and second shelves extending at least one of the walls into the recess, a first elongated generally flat terminal received in one of the terminal receiving grooves of one shell, the terminal having a finger bent back upon itself and being received through the notch in its respective side wall and having a free distal end portion disposed between the first and second shelves, a second elongated generally flat terminal received in the other of the terminal receiving grooves of the one shell, the second terminal having a finger extending through the notch in its respective side wall and having a free distal end portion disposed in the recess, a thermostatic switch having an upper and a lower end, a cup shaped metallic cap member mounted on the lower end of the switch housing and having a bottom surface and a cylindrical outer peripheral surface projecting radially beyond the switch housing, a resistive heater element having opposed contact surfaces, one contact surface electrically connected to the bottom surface of the cap member, the switch being disposed in the recess of the one shell with the cap member received between and held by the shelves and the upper end of the switch aligned with the aperture in the top wall, the distal end portion of the finger of the first terminal in contact with the cap member and the distal end portion of the finger of the second terminal in contact with the other contact surface of the heater element, the first and second terminals and the thermostatic switch all extending out of the recess of the shell, and the other shell received over the first shell, the first terminal received in the other terminal receiving groove of the other shell and the second terminal received in the said one terminal receiving groove of the other shell, the two shells being bonded together to form a unitary housing with the recess of each shell combining to form a switch cavity, the switch and terminals captured between the shells.

9. A time delay relay according to claim 8 in which the first and second terminals are each formed with a tab projecting from opposite sides thereof and a pair of abutments are formed in each terminal receiving groove, the abutments of a pair spaced apart and so located in a respective terminal receiving groove as to receive a terminal tab between the abutments of a pair to locate the terminal in a selected position in the terminal receiving groove.

10. A time delay relay according to claim 8 in which the resistive heater has a positive temperature coefficient of resistivity.

* * * * *